United States Patent [19]

Emoto et al.

[11] 4,398,948

[45] Aug. 16, 1983

[54] METHODS FOR CONTROLLING BLOWING, CONTROLLING THE SLAG FORMATION AND PREDICTING SLOPPING IN THE BLOWING OF MOLTEN PIG IRON IN LD CONVERTER

[75] Inventors: Kanji Emoto; Masayuki Onishi; Hirosuke Yamada; Katsuhisa Hirayama; Hideshi Ohzu; Masakatsu Ogawa; Yasuo Masuda, all of Kurashiki, Japan

[73] Assignee: Kawasaki Steel Corporation, Kobe, Japan

[21] Appl. No.: 268,061

[22] Filed: May 28, 1981

Related U.S. Application Data

[63] Continuation of Ser. No. 100,187, Dec. 4, 1979, abandoned.

[30] Foreign Application Priority Data

| | | | |
|---|---|---|---|
| Dec. 5, 1978 | [JP] | Japan | 53-150261 |
| Dec. 5, 1978 | [JP] | Japan | 53-150262 |
| Dec. 29, 1978 | [JP] | Japan | 53-162196 |
| Mar. 20, 1979 | [JP] | Japan | 54-33033 |
| Jun. 7, 1979 | [JP] | Japan | 54-70633 |

[51] Int. Cl.[3] ..... C21C 5/30

[52] U.S. Cl. ..... 75/60; 75/52

[58] Field of Search ..... 75/52, 59, 60

[56] References Cited

U.S. PATENT DOCUMENTS

| | | | |
|---|---|---|---|
| 3,663,204 | 5/1972 | Jungwirth | 75/60 |
| 3,708,159 | 1/1973 | DeBray | 75/60 |

*Primary Examiner*—P. D. Rosenberg

*Attorney, Agent, or Firm*—Balogh, Osann, Kramer, Dvorak, Genova & Traub

[57] ABSTRACT

Methods for controlling blowing, controlling the slag formation and predicting sloping in the blowing of molten pig iron in LD converter are carried out by measuring acceleration of the horizontal movement of a detector, such as a lance provided in the converter, which is caused only by the slag impinging against the lance, by an accelerator, integrating the measured values to obtain integrated average values at every several seconds, and programming the integrated average values in a computer.

12 Claims, 27 Drawing Figures

METHODS FOR CONTROLLING BLOWING, CONTROLLING THE SLAG FORMATION AND PREDICTING SLOPPING IN THE BLOWING OF MOLTEN PIG IRON IN LD CONVERTER

The present invention relates to a method for controlling the slag formation in an LD converter, a method for predicting the sloping in said converter and a method for controlling the blowing in said converter.

Concerning the control for the end point of an LD converter, a process wherein necessary amount of cooling material and oxygen are calculated by the static model, has been firstly developed and the control using a computer has been introduced.

Thereafter, the dynamic control wherein the carbon content in a molten steel bath and the molten steel temperature are measured by a sublance and the end point is deduced and modified from the result, has been developed and being presently popularized. If this process is used, the accuracy of the carbon content and temperature at the end point have been improved to about 70–80%, while said accuracy in the static model has been 30–40%, but there is the limitation in the dynamic control. Therefore, the inventors have made efforts to obviate this limitation and standardized the blowing process for every class of steel kinds by taking the original conditions of the blowing, that is the components of molten pig iron, temperature and molten pig iron ratio into consideration and this standard has been memorized in a computer as blowing pattern and the program of a lance height, an oxygen flow rate and amounts of auxiliary materials and the like, has been automatically controlled following to said pattern, whereby the accuracy has been improved to about 90%. However, in some conditions of molten pig iron and operation of the converter, it has been impossible to carry out the desired automatic blowing and it has been necessary to control the oxygen volume and the molten steel temperature at the end point more accurately and further if the necessary amounts of P and Mn can be controlled, it is possible to discharge the steel just after the blowing is stopped without confirming the results of analysis and the durable life of the inner lining brick of the converter can be elongated.

For the purpose, it is effective to detect the slag forming conditions in the converter everytime and to introduce the result into the above described automatic control of the program.

As the means for detecting the slag forming conditions, it has been heretofore attempted to measure the sound in the converter but the information is indirect and the accuracy is not sufficient and further an apparatus for detection is usually arranged just above the converter, so that the apparatus is disadvantageously exposed to the unfavorable circumstances, such as high temperature and dusts. Separately, there has been a process wherein the waste gas is analyzed, but this process is also an indirect information and delays against the reaction in the converter, so that this process can not be satisfactorily utilized.

the inventors have found that in the programmed automatic control blowing in the blowing control of LD converter, wherein the blowing process is standardized and memorized in a computer and then the blowing is carried out in order to improve the accuracy at the end point, a vibrometer is provided at the oxygen blowing lance, whereby the acceleration of the lance movement caused by movement of the slag is measured and the advancing conditions of the slag formation is determined and the result is reflected to the automatic modification of the above described programmed lance height and oxygen flow rate, whereby the good result can be obtained.

The present invention will be explained in more detail.

For a better understanding of the invention, reference is taken to the accompanying drawings, wherein:

FIGS. 1(*a*)–1(*f*) show the waveforms of the acceleration variation of the main lance during the blowing in the converter;

Figures 19A, 19B:
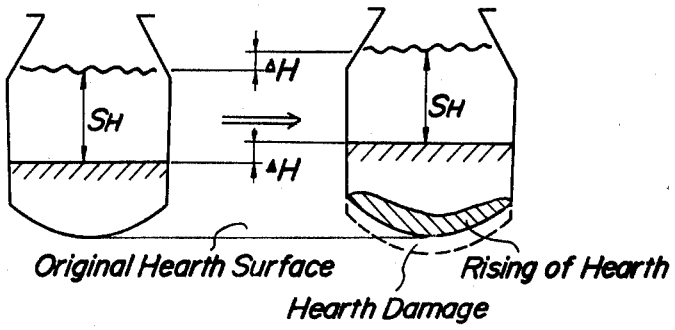
Figure 20:
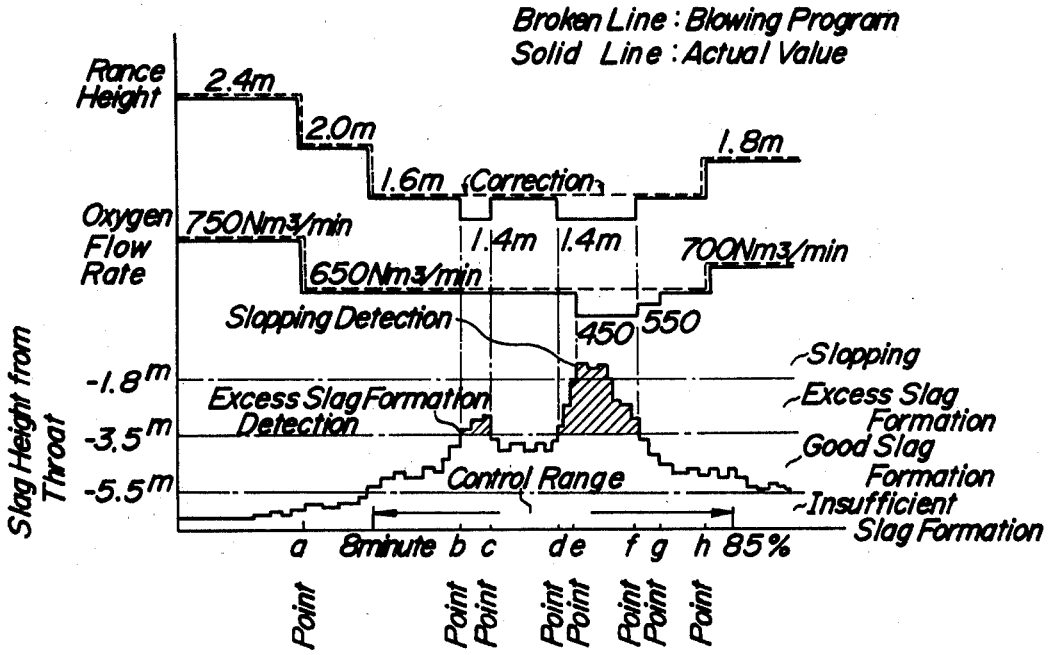
Figure 21A:
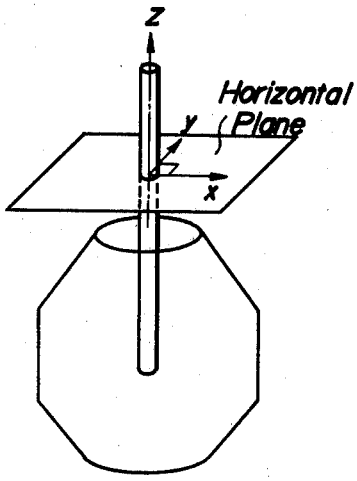
Figure 21B:
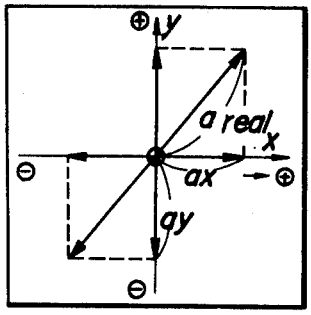
Figure 22:
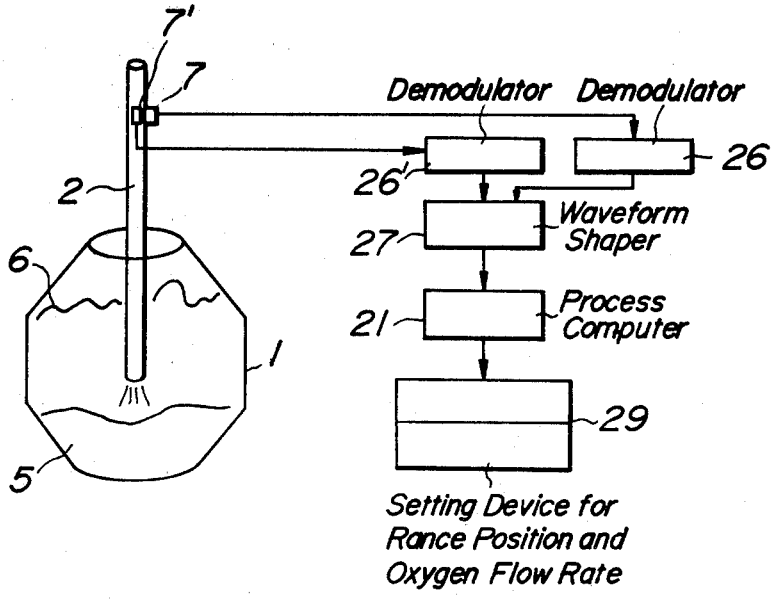
Figure 23:
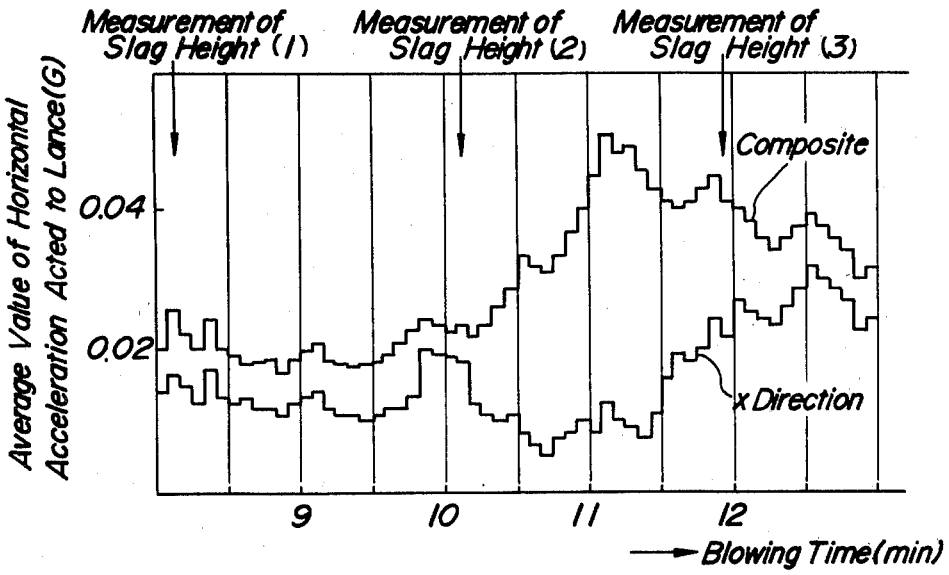
Figure 24:
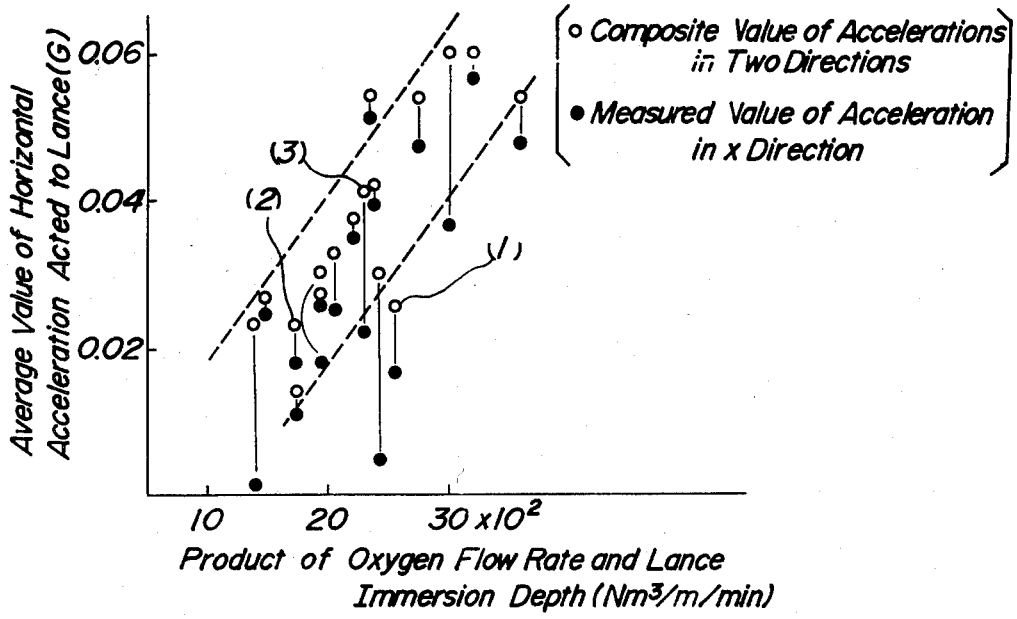

FIGS. 19*a* and 19*b* are explanatory views showing the influence by variation of the converter hearth;

FIG. 20 is an explanatory view showing the blowing control and adding thereto the slag formation control according to the present invention;

FIG. 21*a* and 21*b* are views for explaining two directional measurement of acceleration;

FIG. 22 is an explanatory view of an apparatus for carrying out the method of the fifth aspect of the present invention;

FIG. 23 is an explanatory view showing one embodiment of a variation followed to the time elapsed of an average value of acceleration in the horizontal direction acting on the lance with respect to the average value in the x direction and the composite value; and FIG. 24 is a graph showing a relation between the acceleration in the horizontal direction acting on the lance and a product of an oxygen flow rate and a lance immersion depth.

The inventors have found a method for controlling the slag formation in the converter, by which the sloping is prevented and the optimum slag forming condition depending upon the molten steel kind can be obtained.

It is advantageous to directly detect the kinetic energy of the slag by a detector, such as main lance, sublance, and the like which is directly impinged by the slag splash in the converter or moved by immersion in the foamed slag, without passing through the intermediate medium. Particularly, in this case, the impact of the splash against the lance is quite irregular and when the lance is immersed in the foamed slag, since the lance is subjected to irregular energy under the restrained state, it is more advantageous to detect the energy with the acceleration than to measure the vibrating displaced amount of the lance.

However, in the variation of the acceleration detected in this case, the influence of the melt in the converter is added to the natural vibration of the lance and the hose connected thereto, so that unless such natural movement is separated and removed, the correct slag forming status can not be detected.

Figure 1:
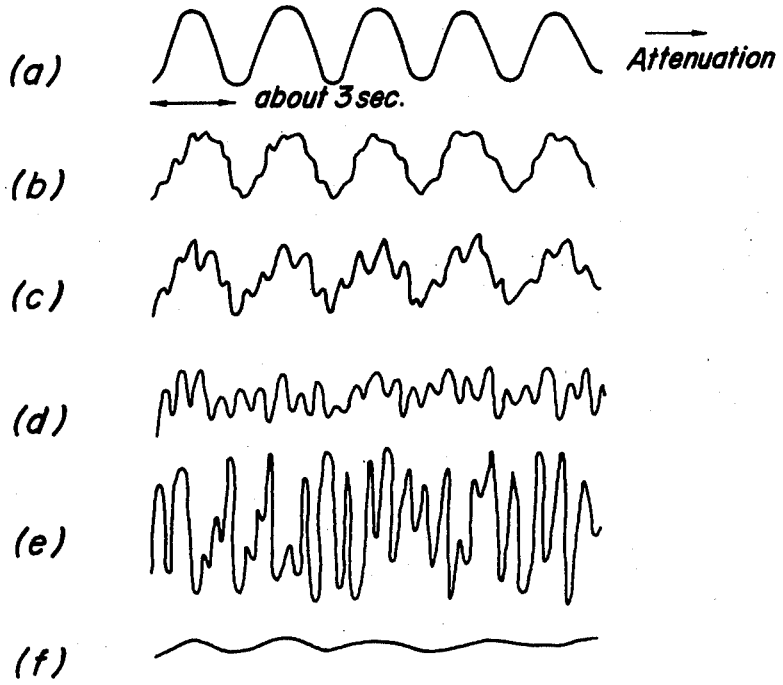

In this aspect of the invention, in order to most correctly detect the condition in the converter during blowing, particularly the variation of the slag formation by the above described detector for acceleration, the energy directly given to the detector by the splash of slag or metal or the foamed slag is detected in the form of acceleration variation by an accelerometer, for example, the crystal vibrator, provided at an upper portion of the detector. It has been found from experiment that the waveforms of the acceleration variation of the main lance during blowing are classified into the forms as shown in FIGS. 1(*a*)–1(*f*). The minimum scale in the abscissa shown in FIG. 1 is about 3 seconds.

In general, the waveform of the acceleration variation of the lance during blowing, when starting, is the form (a) and becomes the form (f) by attenuation and when the lance height is varied or the auxiliary materials are charged, the form (a) again appears. However, it has been found that when the slag formation proceeds, the waveforms become the forms (b) and (c) and when the slag formation is the favorable state, the waveform becomes (d), while when the sloping occurs, the waveform becomes a quite irregular one having a large frequency as shown in (e).

When the acceleration of movement of the lance during blowing is detected, it is impossible to neglect the influence of the lance hose and, for example, when the lance height is varied, the hose vibrates at the moment and the vibration is different depending upon the installation, but continues for dozens of seconds and then the vibration attenuates.

In addition, when the auxiliary materials are charged into the converter, at the moment when said materials impinge against the lance, this gives vibration to the lance and the hose and disturbs the detection of the slag formation. Furthermore, when the molten steel deposits on the lance, the above described vibrations are respectively different.

Figure 2:
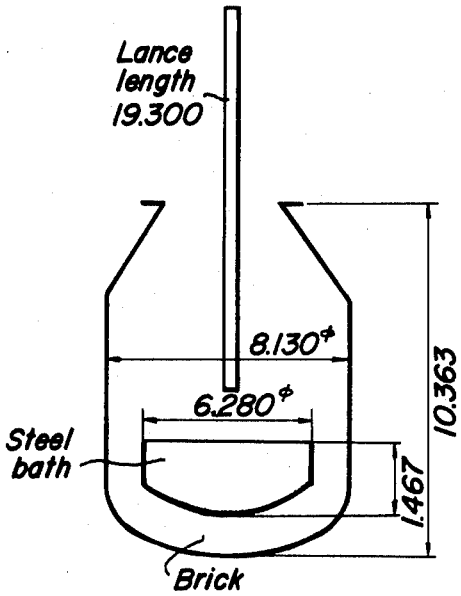
FIG. 2 is a view for showing the dimensions of the converter to be tested.

When the acceleration variation of the lance having the size as shown in FIG. 2 is analyzed with respect to the frequency, it has been found that in the converter of 250 t, the vibration of a low frequency of about 0.3 Hz is based on the natural vibration of the lance and the hose and does not directly show the slag forming conditions. That is, the waves having low frequency as seen in the forms (a), (b), (c) and (f) among the waveforms of FIG. 1 show such natural vibration and as in the waveforms (b) and (c), small waves having high frequency mounting on such waves show the energy given to the lance by the slag splash or foamed slag.

The acceleration variation due to the slag having higher frequency than the natural vibration due to the lance and the hose is not regular in the waveform but the frequency is about 1–2 Hz and is within a fairly narrow range in the above described 250 t of converter.

It is supposed that this frequency is different depending upon the profile of the converter but the frequency can be easily distinguished from the natural frequency of the lance.

The waveform after eliminating the acceleration variation component of low frequency is integrated and the level of the integrated values is classified into several zones. If the slag forming condition is discriminated by the height of the above described classified zone and this discrimination is combined with the variation of the blowing condition, the blowing can be controlled. Furthermore, the sloping can be predicted by utilizing the variation of the above described integrated values.

Figure 3:
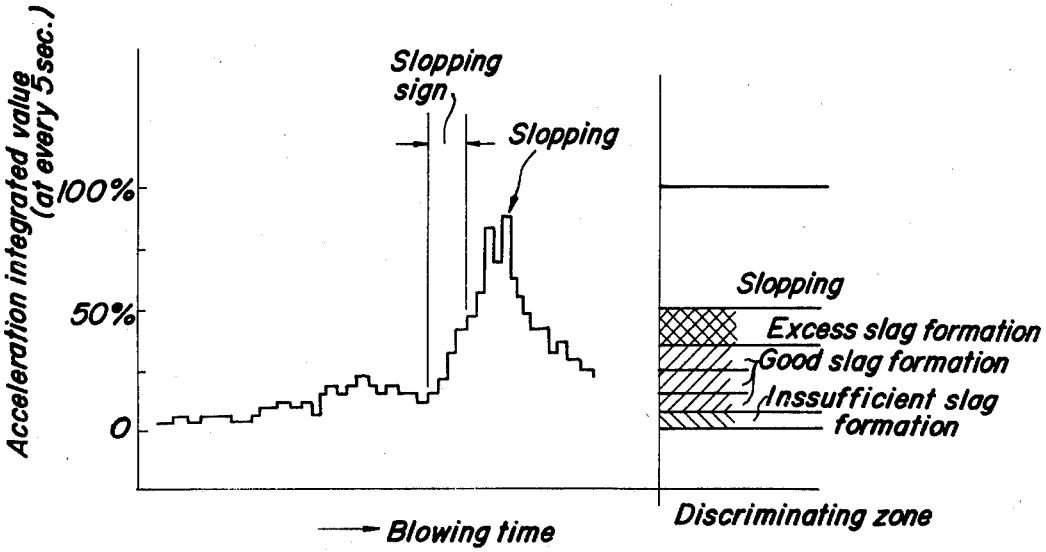
FIG. 3 is a graph showing variation of the integrated values of acceleration, which occurs in the blowing.

In FIG. 3, the integrated values of the acceleration at every 5 seconds are calculated and the obtained values are shown in a curve. The action of the lance height and the oxygen flow rate is conducted by the discriminating zone corresponding to the average value of the calculated integrated values for 20 seconds. Furthermore, the sloping can be predicted by the raising rate of the integrated values. In this case, in the variation of the average value of every 20 seconds, the response delays, so that it is more desirable to make the detection by the raising rate of the integrated value at every 5 seconds.

Figure 4:
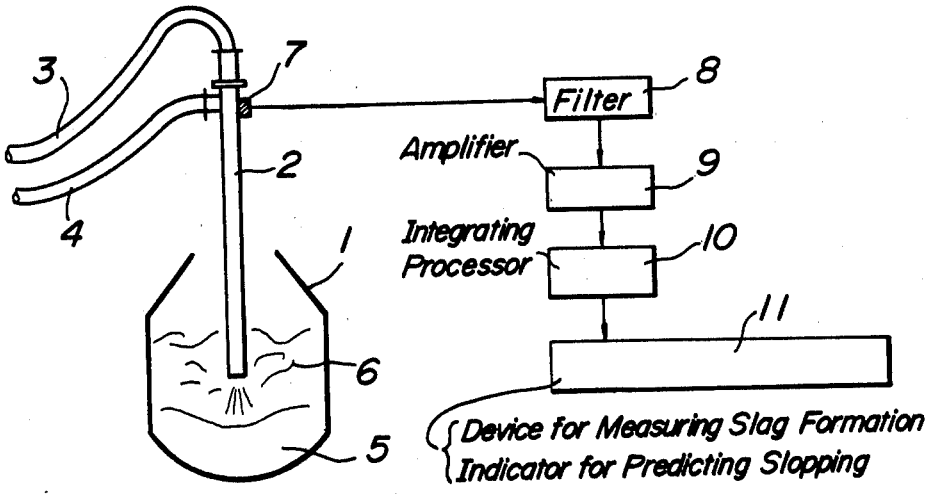
FIG. 4 is an explainatory view of an apparatus for carrying out the method of the first aspect of the present invention.

FIG. 4 shows an installation for carrying out the first aspect of the present invention. In FIG. 4, the numeral 1 is a converter, the numeral 2 is a main lance, the numerals 3 and 4 are hoses for supplying oxygen and cooling water respectively, the numeral 5 is a molten steel in the converter, the numeral 6 is a foamed slag, the numeral 7 is an accelerometer, the numeral 8 is the filter, the numeral 9 is an amplifier, the numeral 10 is an integrating processor and the numeral 11 is the device for measuring the slag formation and an indicator for predicting the sloping.

When the kinetic energy of the slag is directly detected by the lance or sublance inserted in the converter in the manner as described above, the accuracy is much higher than the method measuring through the other intermediate medium.

When the vibrating movement of the lance and sublance is measured, the accuracy of detecting the slag formation can be improved by using the accelerometer in order to detect the irregular energy under the restrained state and further by separating the acceleration variation owing to the natural frequency of the lance and the hose and the acceleration variation due to the slag and integrating only the latter.

The free vibration of the lance and the hose caused by the mechanical impact due to the lance hanging mechanism and the lance supporting mechanism when the lance height is changed, varies in the vibrating state, because when the lance height changes, the length from the supporting point to the lance top changes and further the lance weight varies due to deposit of the molten steel on the lance, so that it is important that the acceleration variation due to the natural frequency of the lance and the hose is excluded.

Furthermore, concerning the first aspect of the present invention, the inventors have found a method for predicting the sloping in the converter wherein an operation for preventing the sloping caused during blowing in the converter can be carried out before sloping and as described.

In general, the sloping phenomenon in the converter includes the case when the foamed slag level is gradually raised and overflows from the opening of the converter and the case when an accidental sudden reaction is caused and an explosive sloping occurs and the former can be predicted to a certain degree by observing the scattering state of slag molten drops at the throat of the converter by naked eyes or by conventional process, while the latter accidental sloping occurs in short time and therefore the prediction is very difficult.

However, the acceleration of the lance movement can be measured without delaying time and is directly transferred from movement of the slag, so that this is most preferable for predicting the occurrence of sloping. That is, as shown in FIG. 5, when the acceleration of the movement in horizontal direction of the main lance is measured by, for example, a crystal oscillating accelerometer 2, the value of this acceleration becomes larger following to advance of the slag formation and the value correctly corresponds to the vigorous force of the slag foaming.

Figure 5:
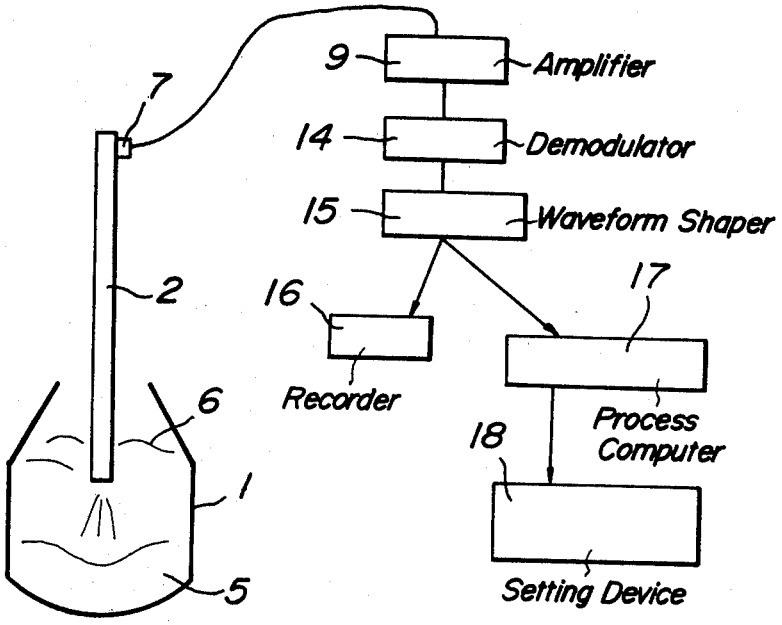
FIG. 5 is an explainatory view of an apparatus for carrying out the method of the second aspect of the present invention.

In FIG. 5, the numeral 1 is the converter, the numeral 5 is the molten steel during blowing in the converter, the numeral 6 is the slag formed in the converter, the numeral 9 is the amplifier in the measuring device connecting to the accelerometer 7, the numeral 14 is a demodulator, the numeral 15 is a waveform shaper, the numeral 16 is a recorder, the numeral 17 is a process computer and the numeral 18 is a setting device for the lance position and/or the oxygen flow rate.

Figure 6:
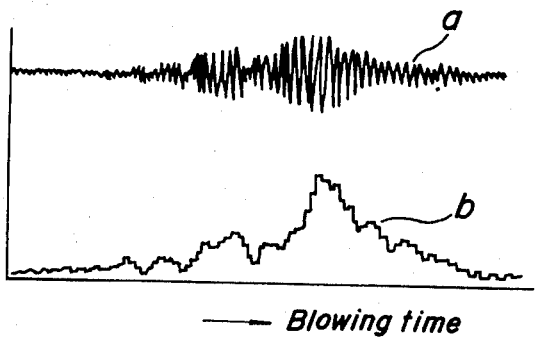
FIG. 6 is a graph showing the original waveform of the acceleration of the lance movement in the horizontal direction and the variation of the integrated average value at every several seconds.

The above described acceleration variation is subjected to the operation process mentioned hereinafter following to the second aspect of the present invention and the obtained value is utilized for predicting the slag foaming condition after 10 seconds to dozens of seconds. The acceleration of the main lance 2 detected by the accelerometer 7 is integrated at every several seconds by the waveform shaper 15 and the result in which the variation during blowing is recorded, is shown in FIG. 6. In FIG. 6, (a) shows the original waveform and (b) shows the variation of the integrated average values at every several seconds.

Figure 7:
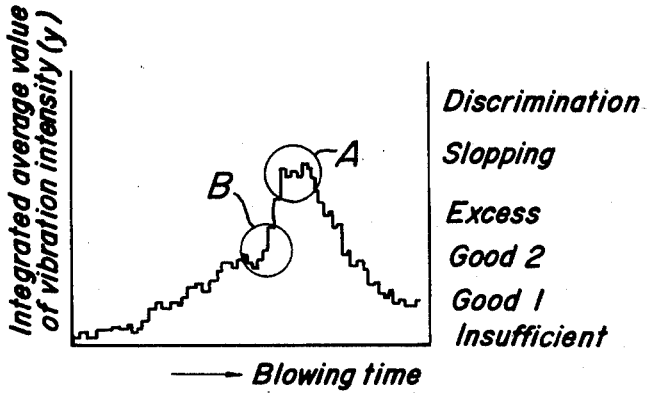
FIG. 7 is a graph for explaining the manner for discreminating the slag formation.

The integrated average values at every several seconds are accumulated at every 20–30 seconds and the slag forming condition can be discriminated by the levels as shown in the ordinate at the right side in FIG. 7.

The inventors have found the automatic blowing control technic wherein this level is classified into five zones as shown in FIG. 7 and the classified zones are utilized for discriminating the slag forming condition and when the discrimination deviates from the scope of the ideal vibrating intensity, the blowing condition varies.

In the embodiment for discriminating the slag formation in FIG. 7, the portion A is the time when the sloping occurred but in this invention the behavior of the portion B just before the sloping occurs, is particularly noticed and it is intended to predict the sloping thereby.

Namely, it is estimated or calculated by formulating the time variation of the integrated average values of the acceleration of the lance vibration in the portion B, when the sloping occurs after how many seconds pass.

Figure 8:
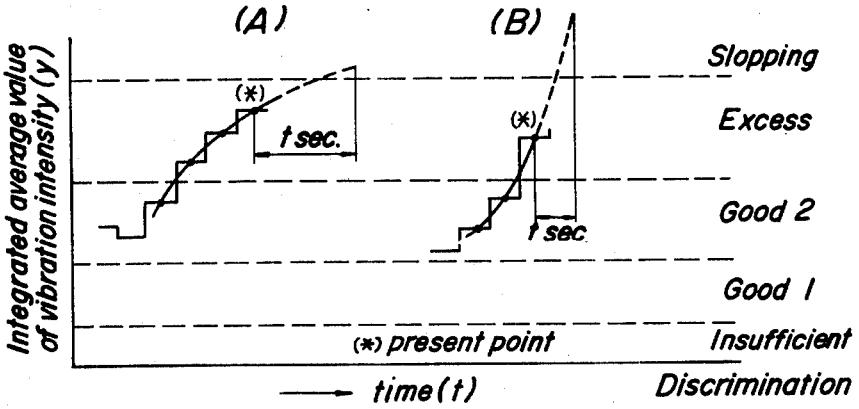
FIG. 8 is a conceptional view of variation of the converter condition to occurrence of the sloping.

The state of the time variation of the integrated average values of the acceleration of the lance vibration when the sloping occurs, is enlarged and shown in FIG. 8.

The time variation of the integrated average values just before causing the sloping shows the quadratic functional or exponentional functional increase as shown in FIG. 8, A and B, so that by presuming that this time variation follows to the formula $$y=at^2+bt+c \quad (1)$$

$$y=ae^t+b \quad (2),$$

the coefficients a, b and c are determined and the estimator of the integrated average values of the vibration intensity after t second is calculated and when this value enters the sloping discriminating zone, the blowing condition is pertinently changed and the sloping can be effectively prevented.

Figure 9A:
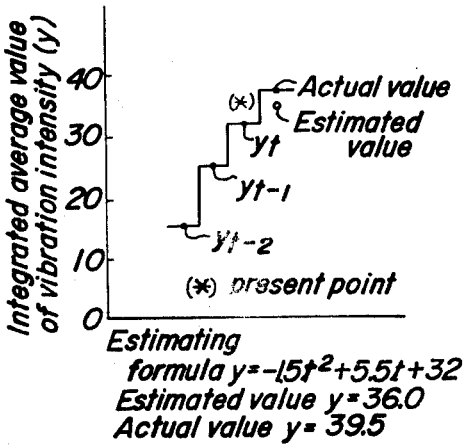
FIG. 9 is graphs showing the embodiment of the estimation of the present invention.
Figure 9B:
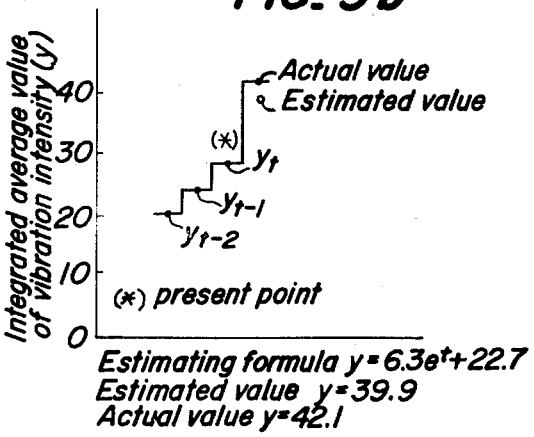

An estimating or calculating embodiment carried out in 250 t of converter is shown in FIGS. 9(*a*) and 9(*b*) but the error of the estimated or calculated value and the actual value after 5 seconds was only about 4%. The formula (1) or (2) used in this estimation or calculation was used under the following condition:

$y_t-y_{t-1}<y_{t-1}-y_{t-2}$: The formula (1) is used.

$y_t-y_{t-1}>y_{t-1}-y_{t-2}$: The formula (2) is used.

In order to practically prevent the sloping, a spare time for conducting the action is necessary and when the estimating or calculating distance is too far, the estimating accuracy lowers, while when said distance is too short, the sloping can not be prevented, so that the inventors carry out the estimation or calculation after 15 seconds and when the estimated or calculated value enters in the sloping zone, the system is controlled so as to lower the lance height and to decrease the oxygen flow rate and by combining the automatic blowing using control of the slag formation according to measurement of the lance vibration, the occurrence of the sloping was decreased from 23% to 3%.

Figure 10:
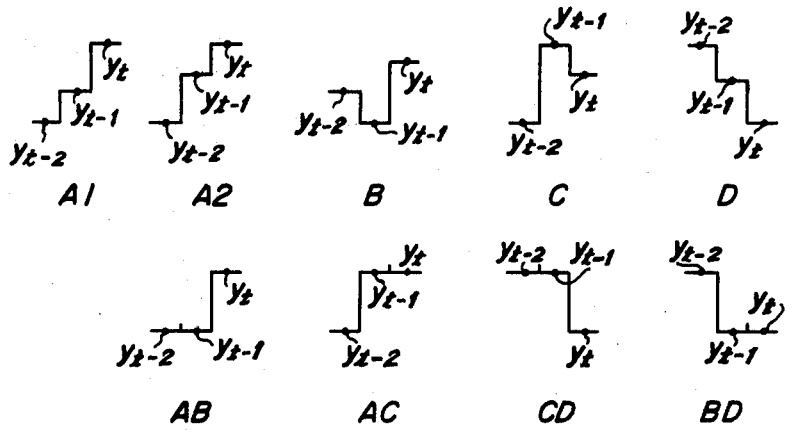
FIG. 10 shows the classified pattern views of the variation of the acceleration of the lance movement.

In this case, the output of the waveform shaper 15 was scanned in the process computer 17 at every 5 seconds and when all the values of the successive three time points are in the good 2 zone in FIG. 8, the pattern discrimination was carried out upon scanning of the three time points. Namely, the variation of the scan value of the three time points is classified into nine patterns as shown in FIG. 10.

In order to represent all integrated average values varied with time, three successive integrated average values are classified to nine patterns by possible combination of the integrated average values as shown in FIG. 6. It is found that the time variation of three successive integrated average values actually measured always belongs to any one of the above nine patterns and thus the time variation of integrated average values of acceleration for lance movement can be represented by a functional formula.

The estimating or calculating formula of these patterns using the actual scan values is as follows:

| Pattern | Estimating or Calculating formula | Actual scan values used |
|---|---|---|
| $A_1$ | (2) | $y_{t-1}$, $y_t$ |
| $A_2$ | (1) | $y_{t-2}$, $y_{t-1}$, $y_t$ |
| B | (1) | $y_{t-2}$, $y_{t-1}$, $y_t$ |
| C | (2) | $(y_{t-2} + y_{t-1})/2$, $(y_{t-1} + y_t)/2$ |
| D | No action | |
| AB | Following to $A_1$ or $A_2$ | |
| AC | Following to C | |
| CD | No action | |
| BD | Prediction is impossible | |

Figure 11:
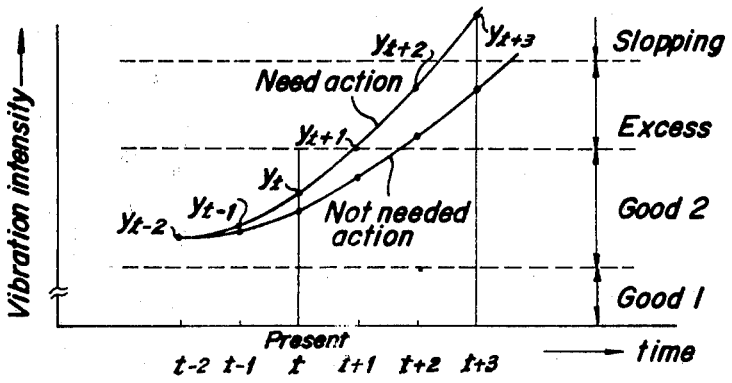
FIG. 11 is a graph for discriminating the sloping.

In this manner, it can be discriminated as shown in FIG. 11 whether the estimating or calculating value before the three time points enters the sloping zone or not and when said value enters said zone, the correction action is conducted by taking this estimation or calculation as the predicting information and the operation is returned to the pertinent slag formation zone.

Thus, as combined the first and second aspects with the method of the programmed automatic control blowing mentioned hereinafter, the inventors have found that the accuracy at the end point is further increased, and the good result can be obtained.

Figure 12:
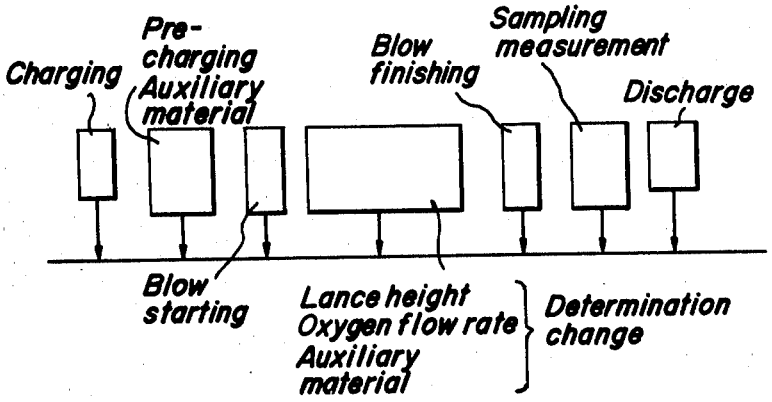
FIG. 12 is a flow sheet for showing the operation order of the blowing in the converter.

The blowing in the converter is carried out by the operation order shown by the flow sheet of FIG. 12.

Namely, the main operations from the blow starting to the steel discharge are changing of the auxiliary materials, the lance height and the oxygen flow rate and these operations have been heretofore carried out manually.

In the present invention, as the first step, the conventional manual blowing process is optimized to the respective class of steels and classified by the original conditions (molten pig iron, operation conditions and the like) and this is set in some blowing patterns.

These patterns ae memorized in the computer and in the actual blowing, the auxiliary materials are charged into the converter following to the program and the lance height and the oxygen flow rate are varied following to the previously set program. In order to control the amount of oxygen and the temperature of the molten steel at the end point, a sublance is immersed in the molten steel bath before 2–3 minutes of the finish of the blowing and the carbon content and the temperature in the molten steel are measured and by using the result the amount of oxygen and cooling material necessary for obtaining the aimed carbon content and molten steel temperature are calculated from the dynamic model and the automatic correction is effected by the calculation and the corrected amounts are charged into the converter.

The above described process is referred to as the programmed automatic control blowing by the inventors but since the original conditions vary fairly greatly, so that when the previously set program is not proper, the slag formation becomes insufficient or excess and the automatic control may become infeasible.

Furthermore, the terminal control has heretofore mainly aimed to obtain the accurate carbon content and molten steel temperature and the removal of phosphorus has greatly depended on the sixth sense of the operator, but presently the accuracy of the carbon content and the molten steel temperature has been improved and unless the amounts of phosphorus and manganese at the end point reach stably the aimed value, the effect of obtaining the accurate carbon content and temperature is not fully developed.

For the purpose, if the conditions of advance of the slag formation can be correctly measured, the automatic correction of the program becomes feasible and the stabilization of the blowing can be attained.

As this means, based on the conventional field knowledge that the advance of slag formation closely relates to the movement of the lance, the process wherein the acceleration of movement of a detector, which is provided in the converter, for example, the lance for blowing is measured by a crystal vibrator and the average value within a given time section is utilized as the control parameter, has been developed.

The acceleration of the lance movement is measured by the crystal vibrator and the waveform is analyzed and as the result it has been found that said movement is divided into the free movement caused when the lance clamp is opened and the restrained movement caused by the slag movement. The frequency zone of the free vibration is lower than the frequency zone of the restrained vibration and for example, the former is 0.1–0.5 Hz, while the latter is 1–2 Hz. In the actual control, by utilizing the fact that both the frequency zones are different, it is necessary to selectively utilize only the latter.

An average intensity for a given time is determined by integrating the waveform of this acceleration and the standard is set, whereby the lance height and the oxygen flow rate, which have been set in program, are automatically corrected.

Figure 13:
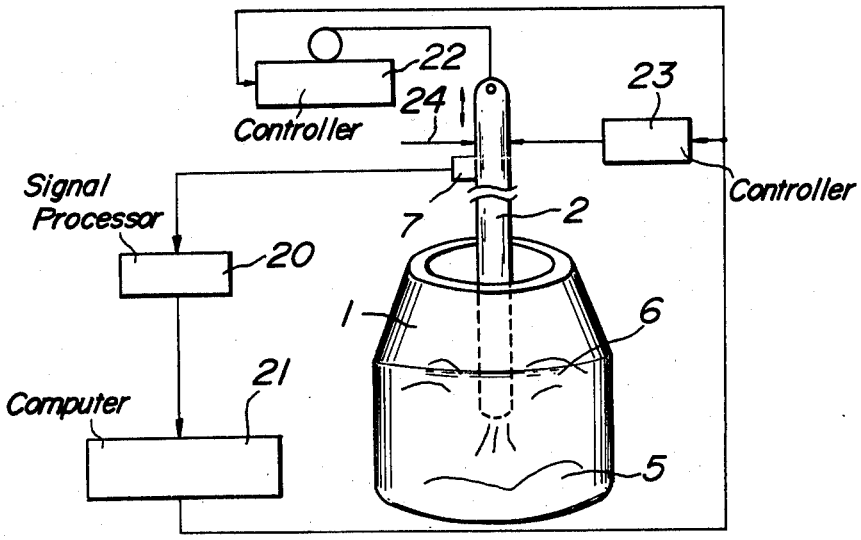
FIG. 13 is an explanatory view of an apparatus for carrying out the method of the third aspect of the present invention.
Figure 14:
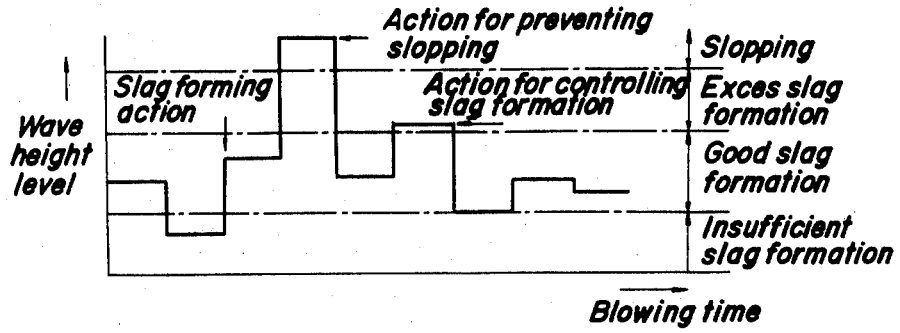
FIG. 14 is a view of explaining the slag forming condition depending upon the wave height level obtained by detecting the acceleration acting on the lance based on movement of the slag.

FIG. 13 shows the apparatus for practically carrying out the third aspect of the present invention and FIG. 14 shows an example thereof.

As shown in FIG. 13, the accelerometer 7 using a crystal vibrator is provided at an upper portion of the lance 2 and a signal detected at the vibrator is shaped by a signal processor 20 and supplied to a computer 21. By signal, the signal with the previously set proper level signal, the computer 21 instructs variation of the setting of a controller 22 of the lance and a controller 23 of oxygen flow rate. The numeral 24 is a cooling water system of the lance 2, the numeral 1 is the converter, the numeral 5 is the molten steel and the numeral 6 is the formed slag.

The above described signal processed waveform corresponds to the slag forming condition in the converter by the size of the wave height level, so that the slag form status is discriminated in zones of the insufficient slag formation, the good slag formation, the excess slag formation and the sloping as shown in FIG. 14 and the lance height and/or the oxygen flow rate is adjusted so as to obtain the good slag formation.

The inventors have obtained the control range by the operation experience in Example mentioned hereinafter, in which the insufficient slag formation and the excess slag formation can be controlled by adjustment of the lance height within 100 mm and the slopping can be controlled by lowering the lance within 300 mm and by decreasing the oxygen flow rate less than 300 $Nm^3$/min.

Each zone of the slag formation, that is, the slag forming level may be appropriately determined by considering the experience of the blowing, for example the delicate variation of the blowing sound and the spitting behavior and therefore it may be necessary to vary the setting of the wave height level zone of the good slag formation shown in FIG. 14 by the property of the installation and the factor of time lapse.

An explanation will be made with respect to the following example.

Figure 15:
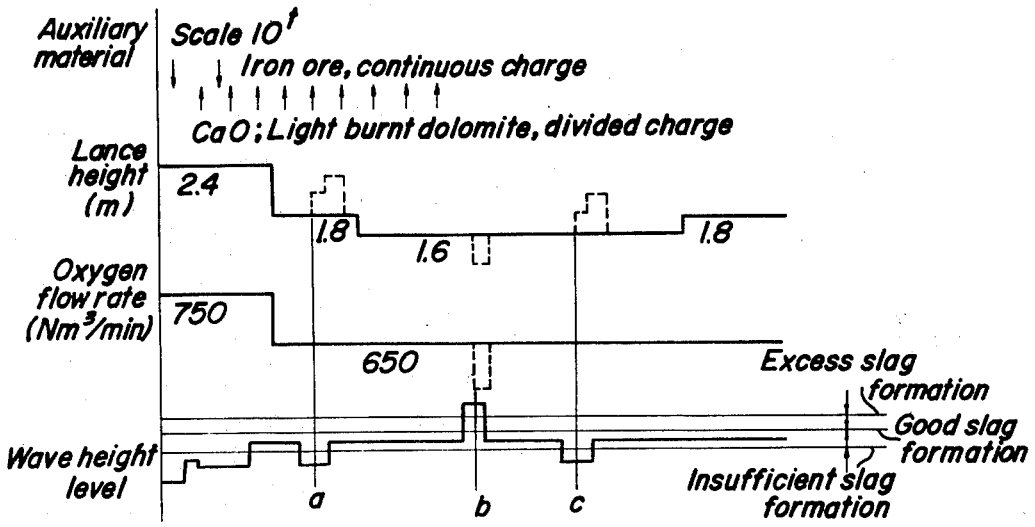
FIG. 15 is a view for explaining the control in an example of the present invention.

In the blowing of SS41 steel (chemical component, C: 0.15%, Si: 0.20%, Mn: 0.70%, P<0.020%, S<0.020%) by using a converter having a capacity of 275 ton, 5 ton of iron ore, 10 ton of mill scale, 10 ton of burnt lime and 5 ton of light burnt dolomite were used and during these materials were graudally charged into the converter as shown by arrows in FIG. 15, the controls of the lance height and the oxygen flow rate shown in the solid line in FIG. 15 corresponding to the steel to be blown were carried out following to the blowing pattern predetermined based on the steel kind.

After the blowing was started, the temperature in the converter was raised with advance of the reactions in the converter, such as decarburization and removal of silicon and simultaneously iron oxide was formed and the iron oxide bonded to the charged burnt lime and light burnt dolomite and these substances were melted to form the slag. Then, the movement of slag in the converter became vigorous together with increase of the slag formation and the lance was vibrated by the influence of the slag formation.

As already mentioned with respect to FIG. 13, the signal detected by the detector for acceleration provided in the converter and in this example by the crystal vibrator 2 provided on the lance 1, was shaped by the signal processor 3. The obtained wave height level is shown by a large solid line at the lower portion in FIG. 15 but this line is compared with the level signals (fine solid lines) previously set in the computer 4.

When the wave height level of the acceleration lies within the previously set zone of the good slag formation level, the blowing is continued following to the set value of the program.

However, when the insufficient slag formation level continues for a give time as shown in point a in FIG. 15, the lance is raised and the soft blowing is carried out. If the insufficient slag formation level further continues, the lance is more raised. The reason why the soft blowing is carried out in this case is based on the fact that the formation of iron oxide becomes easy by raising the lance and the formation of CaO slag is promoted.

Reversely, when the level exceeds the excess slag formation zone as in the point b, an amount of gas formed in the converter is excess and there is the fear that the content in the converter overflows out of the converter, so that the oxygen flow rate is decreased and the lance is lowered. Furthermore, the point c is controlled in the same action as in the point a.

As the result of the blowing, the components when stopping the blowing are as follows.

| | C | P | Mn | Temp. of molten steel |
|---|---|---|---|---|
| Aimed value when stopping blowing | 0.10% | <0.015% | 0.15% | 1,640° C. |
| Actual value when stopping blowing | 0.09% | 0.013% | 0.16% | 1,645° C. |

The blowing in the converter has been heretofore carried out by the experience and the sixth sense of operator but by carrying out the programmed automatic control blowing according to the present invention and by instructing the slag forming condition at the real time and conducting the action, the blowing has become very stable and the accuracy of the control when stopping the blowing has been considerably improved and by preventing the sloping, the yield of iron has been considerably improved and the control of P and Mn has become accurate, so that it has been possible to discharge the steel just after stopping the blowing.

By developing the first aspect of the present invention the inventors have found a method for controlling the slg formation in the converter, wherein the more active the slag foaming, the larger the acceleration in the horizontal direction acting on the detector for acceleration, so that a variation of the acceleration is always observed and the slag formation can be controlled in relation to the special pattern and a slag forming step dependent thereon.

Figure 16:
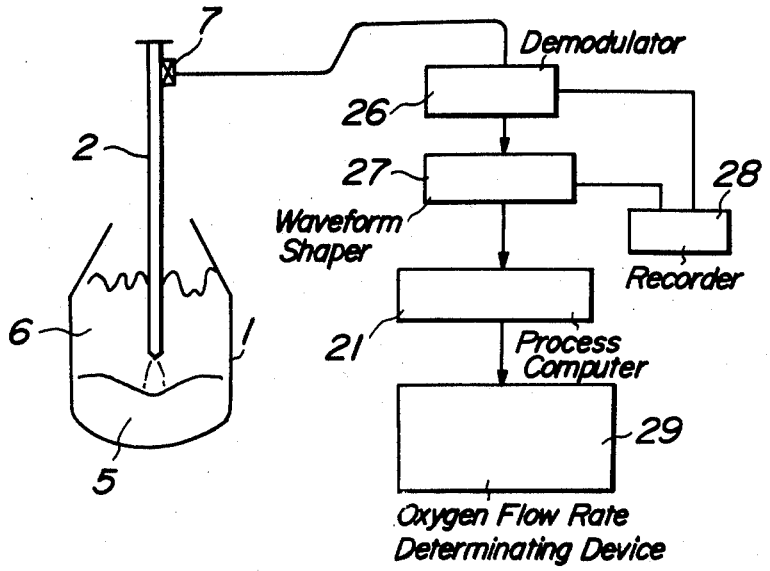
FIG. 16 is an explanatory view of an apparatus for carrying out the method of the fourth aspect of the present invention.

FIG. 16 shows the apparatus for practically carrying out the fourth aspect of the present invention. As shown in FIG. 16, for example, on the upper portion of the lance 2 for blowing oxygen inserted in the converter 1 is secured the crystal oscillating accelerometer 7, the acceleration in the horizontal direction of the lance 2 is detected, and the slag formation is controlled by a system consisting of a demodulator 26, a waveform shaper 27, a recorder 28, a process computer 21 and a setting device 29 for the lance position and oxygen blow rate. The numeral 5 is molten steel and the numeral 6 is the foamed slag.

In the course of an actual operation of the converter blowing under this slag formation control, it is found that the detected values of the above acceleration of the lance are varied by an oxygen flow rate and a lance height under the similar slag forming conditions, so that in order to more improve a detecting accuracy of the slag formation, it has been recognized that correction is necessary in accordance with the oxygen flow rate and the setting value of the lance height.

Figure 17:
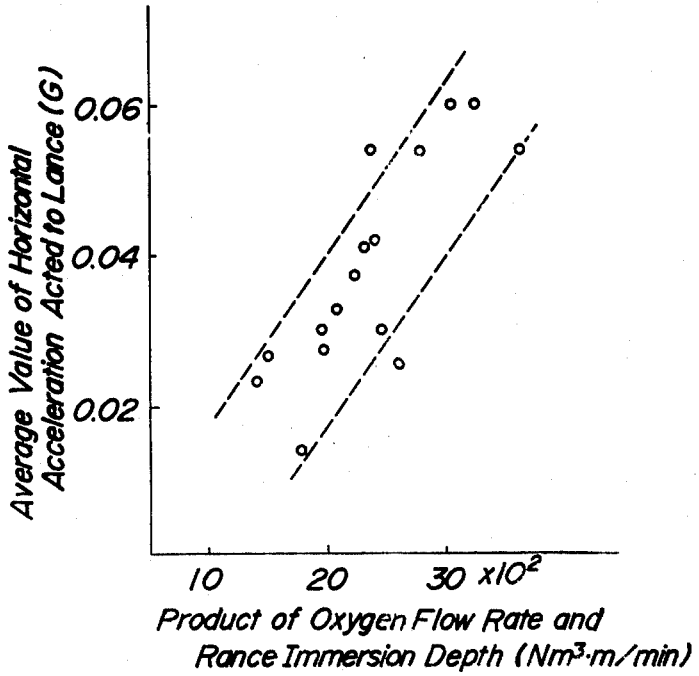
FIG. 17 is a graph showing a relation between the acceleration in the horizontal direction acting on the lance and a product of an oxygen flow rate and a depth of the lance immersed into the slag.

The inventors have mounted an electrode-type probe having a detecting circuit operated by making contact with a top surface of the foamed slag on a sublance during the above blowing operation in a 250-ton converter, actually measured a height of the foamed slag by hanging the sublance together with detection of the acceleration acted to the lance 2 for blowing oxygen, sorted the measured height and the detected acceleration with respect to an instant value at the position of the lance 2 and an oxygen flow rate at that time, and obtained the following relation from the result of data shown in FIG. 17 as an embodiment.

$$G = aFO_2(S_H - L_H) + b \ldots \quad (3)$$

wherein, G is an average value (G) of a horizontal acceleration acted to the lance.

$FO_2$: oxygen flow rate ($Nm^3$/min)

$S_H$: height of foamed slag (m)

$L_H$: lance height (m)

In the above formula, a is a constant by viscosity, specific gravity or the like of the slag, its slight variation cannot be avoided in theory, but it can be treated as a constant one in an actual converter, and in the above operational experiment, a value of $a=2.5\times10^{-5}$ G.min/Nm$^3$.m is suitable. In addition, b is a correction item varied by vibration characteristic of the lance based on kind of converters, installation factors such as a lance-type or the like, for example, a difference of a hanging tension acted on two hanging wires of the lance, and usually fitted to 0 within the range of −0.05 G∼0.04 G.

In this connection, the height of foamed slag $S_H$ and the lance height $L_H$ are measured from a standstill steel bath surface, so that in the above equation, $(S_H-L_H)$ means a depth of the lance 2 immersed into the foamed slag.

As apparent from the formula (3), following to the following formula:

$$S_H = \frac{G-b}{a\cdot FO_2} + L_H \quad (4)$$

the height of foamed slag can be estimated and this estimated value can immediately be utilized for discriminating the slag forming conditions.

Figure 18:
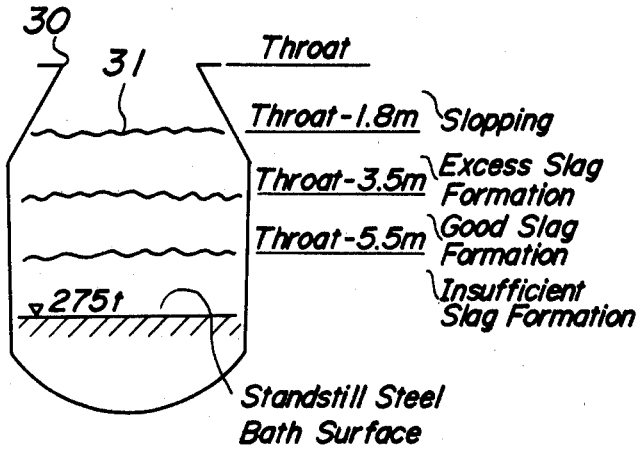
FIG. 18 is an explanatory view showing the discrimination of the slag formation.

A change of the height $S_H$ can be applied to a variation of the slag forming condition, particularly to prediction of development to sloping. Viewed from this point, as shown in FIG. 18, a distance from a converter throat 30 to a top surface 31 of the foamed slag is divided into four levels of less than 1.8 m, 1.8–3.5 m, 3.5–5.5 m and more than 5.5 m, each of which is classified into a zone of danger sloping, a zone of excess slag formation, a zone of good slag formation and a zone of insufficient slag formation.

Incidentally, the standstill steel bath surface in this 275-ton converter is 1.467 m from the hearth and 7.7 m from the bath surface to the converter throat.

In this manner, the fact that the top surface 31 of the foamed slag occupies within 1.8 m from the throat 30 is estimated or calculated according to the formula (4) and the acceleration in the horizontal direction of the lance 2 is detected, and thus, a danger of sloping can easily be predicted.

During one generation of the converter, i.e., a life over a period of replacing bricks, the hearth of the converter is changed by worn bricks or covered with slag, so that it is subjected to a level change of about 0.8 m, and this change brings a level difference ΔH of a standstill steel bath as a standard, as shown in FIG. 19. This produces a difference of the distance from the top surface 31 of the foamed slag to the throat 30, which cannot be ignored with respect to positive prediction of sloping.

From the above consideration, by adding a correction item of the hearth change to the formula (4), the following formula is obtained.

$$SH = \frac{G-b}{a\cdot FO_2} + L_H + \Delta H \quad (5)$$

Following to the zones of slag formation shown in FIG. 18, in order to materialize the optimum slag formation control, a proper adjusting action of the oxygen flow rate and the lance height can be taken from the above formula (5).

In the formula (5), b can optionally be corrected in accordance with a change in installation such as a change of the lance, if such correction is once grasped from operational results, proper selection can easily be carried out from the experience.

FIG. 20 shows an embodiment of a method for controlling a slag formation in an LD converter according to the invention, in which an abscissa is plotted by a time showing the elapse of blowing and an ordinate is plotted by a lance height, an oxygen flow rate and slag forming conditions, i.e., a height of the top surface 31 of the foamed slag.

In fact, no control of slag forming is required in the initial stage and the final stage of blowing, so that the control range is determined from the time after elapsed 8 minutes from the start of blowing to the time when 85% of a predetermined blowing oxygen amount is blown.

The correction action of the blowing condition was carried out based on an average value over 30 seconds of an $S_H$ estimation or calculation obtained at every 5 seconds.

A broken line for showing the elapse of the lance height (m) and the oxygen flow rate (Nm$^3$/min) shown in FIG. 20 shows a setting value previously determined by already established blowing program, while a solid line shows an operational value for controlling slag formation by taking the correction action from the detected result of acceleration in the horizontal direction acted to the lance based on slag forming.

In the first place, according to the blowing program, let the lance height $L_H$ (height from the standstill molten bath surface) be 2.4 m and the oxygen flow rate $FO_2$ be 750 Nm$^3$/min, and the blowing is started. At the point a before entering into the control range, according to the program, the lance height $L_H$ is lowered to 2.0 m and the oxygen flow rate $FO_2$ is lowered to 650 Nm$^3$/min, and the point (8 minutes) entered into the control range, the lance height $L_H$ is 1.6 m and the blowing is carried out according to the program.

After this point, the control of slag formation is carried out according to the invention. As shown in FIG. 20, when the slag height $S_H$ estimated or calculated by the formula (5) exceeds −3.5 m of the zone of excess slag formation, the lance height $L_H$ is corrected to 1.4 m, so that the slag height $S_H$ is returned to the zone of good slag formation at the point c, and at that position, the lance height $L_H$ is brought back to 1.6 m as programmed.

While the blowing is continued, the slag height $S_H$ again reaches the point d and enters into the zone of excess slag formation, so that the lance height $L_H$ is corrected to 1.4 m, but the slag height is still increased to reach to the zone of danger sloping, so that the oxygen flow rate is corrected from 650 Nm$^3$/min to 450 Nm$^3$/min at the point e, and then the slag height $S_H$ is lowered along the course shown in FIG. 20 and the control is suceeded in without any serious mistake by only causing a tendency of slight slopping.

Thereafter, at the point f where the slag height is smoothly lowered toward the zone of good slag formation, the oxygen flow rate is brought back from 450 Nm$^3$/min to 550 Nm$^3$/min and the lance height $L_H$ is also brought back from 1.4 m to 1.6 m.

Then, the slag height $S_H$ is completely returned to the zone of good slag formation at the point g, so that the oxygen flow rate $FO_2$ is brought back from 550 $Nm^3$/min to 650 $Nm^3$/min, and as programmed, the lance height $L_H$ is raised to 1.8 m and the oxygen flow rate $FO_2$ is raised to 700 $Nm^3$/min at the point h, so as to maintain the operation for passing the zone of good slag formation at the point of 85% of a predetermined oxygen flow rate as estimated in the beginning.

After this operation, the orbit correction of blowing is carried out for increasing a good hit on the target for discharging of the steel.

As stated in the above, as compared with a method for indirectly detecting a slag formation such as waste gas analysis and waste gas temperature or vibration and sound of a furnace body, the present invention detects acceleration in the horizontal direction of the lance by slag movement in the form of directly receiving kinetic enegy of the slag, so that the present invention is far superior to the conventional ones in precision. Particularly, the present invention utilizes the fact that acceleration of the lance is in proportion to the product of a depth of the lance immersed into the slag and an oxygen flow rate and estimates a height of the foamed slag, so that it becomes possible to optionally control a slag formation by correcting a variation of the oxygen flow rate and the change of the lance height and by precisely grasping the height of the foamed slag without any fear of sloping.

Furthermore, by developing the fourth aspect of the present invention the inventors have found a method for controlling a slag formation in the converter wherein acceleration by movements of an article hung in the converter in the directions orthogonal to a horizontal plane with each other, respectively, is measured and the vector sum of them is obtained as an information source so as to improve a control accuracy.

The fifth aspect of the present invention uses a functional relation of the information, the depth of the lance immersed into the slag and the oxygen flow rate and estimates a height of the foamed slag with precision to make the estimated or calculated values as factors for controlling a slag formation.

The movement of the oxygen blowing lance variously varies its direction in different installation and different blowing method by a variation of its supporting condition, a variation of a reaction condition in the converter or the like, so that in the above-described measuring method for detecting only acceleration in a certain direction, acceleration is varied by a variation of said direction of the movement, so that accuracy for controlling a slag formation based on the above as an information source is lowered.

As a means for solving this problem, the inventors propose a method of measuring acceleration of movement of a lance in two directions (x and y directions) intersected at right angles on a horizontal plane, obtaining a magnitude of true acceleration ($a_{real}$) with the use of the following formula (6) and using the thus obtained value as a control information as shown in FIG. 21.

$$a_{real} = \sqrt{(a_x)^2 + (a_y)^2} \quad (6)$$

wherein $a_{real}$: magnitude of true acceleration $a_x$: magnitude of acceleration in the x direction on a horizontal plane $a_y$: magnitude of acceleration in the y direction on a horizontal plane.

One embodiment of a measuring and treating system for carrying out the fifth aspect of this controlling method is shown in FIG. 22.

FIG. 23 shows one embodiment of a transition of composite (called as a composite value) by the integrated average values of acceleration in the x direction (called as an x direction average value) in blowing with the use of the system shown in FIG. 22 and acceleration in the x and y directions by the formula (6). These values are almost in similar relation until 10 minutes elapsed from the start of blowing, the main vibrating direction is in the x direction but weakened in vibration after 10–20 minutes and transferred to the y direction. After 12 minutes, the vibration in the x direction is again strengthened. Arrows (1), (2) and (3) shown in FIG. 23 show timing for actually carrying out measurement of a slag height ($S_H$) by a sublance.

FIG. 24 plots a relation between an average value G of acceleration in the horizontal directions acted to the lance and a product $FO_2 \times (S_H - L_H)$ of an oxygen flow rate $FO_2$ and a lance immersion depth ($S_H - L_H$) at every timing for actually measuring the slag height $S_H$.

In the above relation, symbols (1), (2) and (3) show data at the time of measuring each slag height $S_H$ in blowing process shown in FIG. 23.

As is seen from FIG. 24, the composite value plotted by a mark o is in almost linear relation to the product $FO_2 \times (S_H - L_H)$, and its scatter is small, but an average value in the x direction has no distinct relation with the product $FO_2 \times (S_H - L_H)$, because as understood from compairson of the plot (1) with the plot (2), the main vibrating direction differs at every timing of measurement and this becomes disturbance and a large scatter. In case of using the composite value, even with any of timings (1), (2) and (3), a linear relation with less scatter can be maintained.

Accordingly, in case of measuring a slag height $S_H$ from measured acceleration and controlling a slag formation based thereon, it is necessary to use a composite value by removing any influence of a variation in the vibrating direction.

An embodiment according to FIG. 22 from which the above data was obtained will be explained in detail. To the upper portion of the oxygen blowing lance 2 inserted in the converter 1 are secured two pairs of crystal oscillating accelerometers 7 (x axis) and 7' (y axis) arranged at right angles to each other, accelerations in the x axis direction and the y axis direction of the lance 2 are detected, respectively, and a slag formation is controlled by a system consisting of demodulators 26, 26', a waveform shaper (for shaping waveform and calculating composite of acceleration ($a_{real}$)) 27, a process computer 21 and a setting device 29 for a lance position and oxygen flow rate. The numeral 5 is the molten steel and the numeral 6 is the foamed slag.

In the course of actual operation of the converter blowing under the control of a slag formation based on the above composite value, it is found that the composite values of the lance are varied by an oxygen flow rate and a lance height even under almost similar slag forming condition, so that in order to improve detecting accuracy of the slag formation, it has been recognized that correction is necessary in accordance with the oxygen flow rate and the setting value of the lance height.

The control of the slag formation and its analysis by using the composite value of acceleration, the oxygen flow rate and the lance height according to the fifth aspect of the present invention are carried out in the same manner as the fourth aspect of the present invention. Therefore, the detailed explanation thereof are omitted. In this embodiment the accuracy of the control of the slag formation can be more improved as compaired with the fourth embodiment.

As stated in the above, the present invention, as compared with an indirect slag formation detecting method with the aid of a waste gas analysis and a waste gas temperature or vibration, sound or the like of a furnace body, is an excellent method in precision at such a point that acceleration of movement of an article inserted into the converter, such as the lance is an information of that which is directly immersed into the foamed slag. According to the present invention irrespective of a variation of the direction of movement by a difference of installation or the like, a precise acceleration of the movement is always detected with high precision as compared with a method with the use of a sound or the like.

What is claimed is:

1. A method for controlling a slag formation in an LD converter, which comprises steps of providing a member vertically hung in the converter to be subjected to slag movements caused by foamed slag, providing an acceleration detector secured to the member for measuring acceleration of horizontal movement acting on the member, integrating the values of said measured acceleration to obtain the average values of said integrated acceleration over every several seconds, and changing at least one of the member's height and oxygen flow rate in the converter using the integrated average values of acceleration so as to control the slag formation in the converter.

2. A method for controlling a slag formation in an LD converter as claimed in claim 1, wherein said member is a main lance for supplying oxygen.

3. A method for controlling a slag formation in an LD converter, as claimed in claim 2, wherein acceleration variation components measured by the acceleration detector are separated into first variation components based on the natural frequency of the main lance, and lance hoses supplying oxygen and cooling water, and second variation components based on the slag formation and only said second variation components are integrated.

4. A method for controlling a slag formation in an LD converter as claimed in claim 3, wherein the waveform of said second variation components of the acceleration is integrated and processed to obtain the average values over every several seconds by a waveform shaper, the level of the integrated average values is classified into at least four zones of insufficient slag formation, good slag formation, excess slag formation and slopping, and the slag forming conditions are discriminated based on these zones by a discriminating means.

5. A method for controlling a slag formation in an LD converter as claimed in claim 1, wherein; in order to blow pure oxygen in the LD converter in a programmed automatic control blowing in which amounts of oxygen and cooling materials necessary for obtaining the aimed carbon content and temperature of the molten steel are calculated by the dynamic model in which previously set blowing patterns are memorized in a computer and the measured information relating to carbon content and temperature obtained by inserting a sublance in the molten steel in course following to the blowing pattern; the variation of the slag forming condition during blowing is detected by movement of the slag in the converter with the use of the acceleration detector thereby to correct the blowing program.

6. A method for controlling a slag formation in an LD converter as claimed in claim 5, wherein the crest value level of the measured waveform of the acceleration caused by movement of the slag in the converter against the acceleration detector is classified into four zones of insufficient slag formation, good slag formation, excess slag formation and slopping, and when the integrated average values correspond to any one of the insufficient slag formation, the excess slag formation and the slopping zones, the waveform level of the acceleration is controlled to direct it to the good slag formation zone by increasing and decreasing as required the lance height and the oxygen flow rate.

7. A method for controlling a slag formation in an LD converter as claimed in claim 1, wherein the method further comprises steps of calculating by a computer a height of the foamed slag from the integrated average values, an oxygen flow rate and a present height of the member measured from a standstill steel bath surface with the use of a functional relation thereof, classifying the calculated foamed slag height into four zones of insufficient slag formation, good slag formation, excess slag formation and slopping, and controlling the foamed slag height to direct it to the good slag formation zone by increasing and decreasing as required at least one of the member's height and the oxygen flow rate when the calculated foamed slag height corresponds to any one of the insufficient slag formation, the excess slag formation and the slopping zones.

8. A method for controlling a slag formation in an LD converter as claimed in claim 7, wherein a function for calculating the slag forming height is expressed by the following formula:

$$S_H = \frac{G - b}{a \cdot FO_2} + L_H + \Delta H$$

wherein $S_H$: slag forming height (m),

G: average value of horizontal acceleration acting the member (G), $FO_2$: oxygen flow rate ($Nm^3$/min), LH: member height (m), ΔH: correction term of the hearth variation in the converter (m), a: constant determined by viscosity and specific gravity or the like of slag, (G.Min/$Nm^3$), and b: correction term of lance vibration based on kind of converters and installation factors (G).

9. A method for controlling a slag formation in an LD converter as claimed in claim 1, wherein the method further comprises steps of measuring acceleration of movement of the member, vertically hung in the converter, in the directions orthogonal with each other on a horizontal plane, obtaining the vector sum of measured acceleration values, and changing at least one of the member's height and oxygen flow rate in the converter using the values thus obtained, so as to control the slag formation in the converter.

10. A method for controlling a slag formation in an LD converter as claimed in claim 1, wherein the method further comprises steps of measuring acceleration of movements of the member vertically hung in the converter in the directions orthogonal with each other on a horizontal plane, obtaining the vector sum of them, calculating a height of the foamed slag from the integrated average values, an oxygen flow rate and a present height of the member measured from a standstill steel bath surface with the use of a functional relation thereof, classifying the calculated foamed slag height into four zones of insufficient slag formation, good slag formation, excess slag formation and slopping, and controlling the foamed slag height to direct it to the good slag formation zone by increasing and decreasing as required at least one of the member's height and the oxygen flow rate when the calculated foamed slag height corresponds to any one of the insufficient slag formation, the excess slag formation and the slopping zones.

11. A method for predicting sloping in an LD converter, which comprises successively measuring acceleration in the horizontal direction of movement of a lance inserted into the converter during blowing, integrating the values of said measured acceleration to obtain the average values of said integrated acceleration over every several seconds, collating three successive integrated average values thus obtained for time variation of said acceleration with corresponding one of a plurality of patterns previously classified by possible combinations of three successive integrated average values of acceleration, discriminating said collated corresponding pattern and formulating said discriminated pattern, whereby the slag forming condition is estimated from several seconds to dozens of seconds of measured time.

12. A method for predicting sloping in an LD converter as claimed in claim 11, wherein the pattern discrimination is given by the following formulas:

$$y=at^2+b+c \quad (1)$$

$$y=ae^t+b \quad (2)$$

wherein a, b and c are coefficients, provided that the formula (1) is used when the time variation y of the integrated average values just before occurrence of the slopping is $y_t-y_{t-1}<y_{t-1}-y_{t-2}$ and the formula (2) is used when the time variation y is $y_t-y_{t-1}>y_{t-1}-y_{t-2}$.

* * * * *